US006203353B1

(12) United States Patent
Huang et al.

(10) Patent No.: US 6,203,353 B1
(45) Date of Patent: Mar. 20, 2001

(54) ELECTRICAL CONNECTOR WITH PASSIVE CLIP

(75) Inventors: Wayne Huang, Alhambra, CA (US); Ta-Nien Chao, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/439,644

(22) Filed: Nov. 12, 1999

(51) Int. Cl.[7] ..... H01R 13/627
(52) U.S. Cl. ..... 439/352; 439/357; 439/607
(58) Field of Search ..... 439/607, 609, 439/358, 357, 352

(56) References Cited

U.S. PATENT DOCUMENTS 4,857,008 * 8/1989 Kee et al. ..... 439/352
5,219,300 * 6/1993 Yagi et al. ..... 439/352
5,254,014 * 10/1993 Yagi et al. ..... 439/357
5,330,366 * 7/1994 Tsuji et al. ..... 439/352
5,480,313 * 1/1996 D'Alayer De Costemore D'Arc ..... 439/352
5,498,171 * 3/1996 Semaan ..... 439/352
5,830,001 * 12/1999 Kinoshita et al. ..... 439/354
6,007,382 * 12/1999 Wu ..... 439/607

* cited by examiner

*Primary Examiner*—Gary F. Paumen
(74) *Attorney, Agent, or Firm*—Wei Te Chung

(57) ABSTRACT

An electrical connector comprises a housing defining a receiving cavity having at least a rear wall thereof. A plurality of passageways extends through the rear wall. The housing has a top outer surface in which at least an opening is defined thereof and is in communication with the cavity. A tongue extends from the rear wall and defines a plurality of slots aligned with the passageways. An elongate strip is bridged between longitudinal ends of the opening and includes a biasing dimple extending into the cavity for engaging with the inserted connector.

1 Claim, 7 Drawing Sheets

ELECTRICAL CONNECTOR WITH PASSIVE CLIP

FIELD OF THE INVENTION

The present invention relates to an electrical connector, and more particularly to an electrical connector with passive clips which provide accurate and reliable operation.

DESCRIPTION OF THE PRIOR ART

In order to ensure a reliable coupling between first and second connectors, latching means is arranged between the mated connectors. For example, the latching means generally includes locking loops arranged on opposite ends of the first connector, and looks on the second connector corresponding to the locking loops.

In general, the latching means can be divided into an active type, and a passive type. The active means that lock and/or unlock of the latching means require manual operation to trigger it. The passive means that lock and/or unlock of the latching means can be readily triggered without manual operation. Generally, connectors with smaller dimension is equipped with the passive type locking mechanism because the locking means is too small to be accessed. For example, the power connector used to charge the mobile phone has a comparatively smaller dimension and is equipped with the passive type locking mechanism. However, with such a small housing, arrangement of such passive type locking mechanism is really a problem.

In the existing art, the passive type locking mechanism is made from plastic material which experiences a material fatigue or insufficient retaining force.

SUMMARY OF THE INVENTION

An objective of this invention is to provide an electrical connector which a passive locking device which is integrally formed with a metal shield.

In order to achieve the objective set forth, an electrical connector in accordance with the present invention comprises a housing defining a receiving cavity which defines at least a rear wall thereof. A plurality of passageways extends through the rear wall. The housing has a top outer surface in which at least an opening is defined thereof and is in communication with the cavity. A tongue extends from the rear wall and defines a plurality of slots aligned with the passageways. An elongate strip is bridged between longitudinal ends of the opening and includes a biasing dimple extending into the cavity for engaging with the inserted connector.

These and additional objects, features, and advantages of the present invention will become apparent after reading the following detailed description of the embodiment of the invention taken in conjunction with the appended drawings.

DESCRIPTION OF PREFERRED EMBODIMENT

Figure 1:
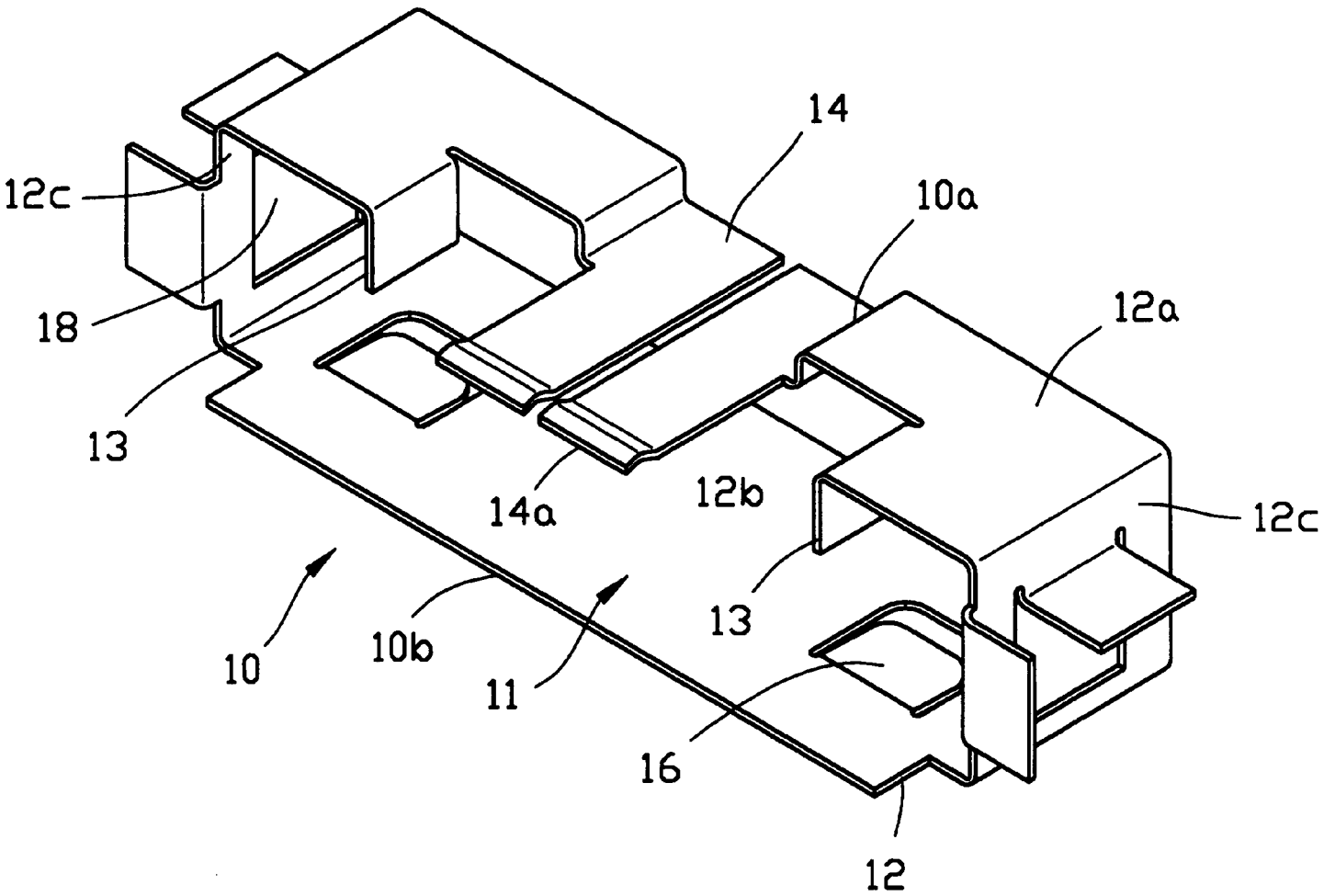
FIG. 1 is a perspective view of a metal shield in accordance with the present invention.
Figure 2:
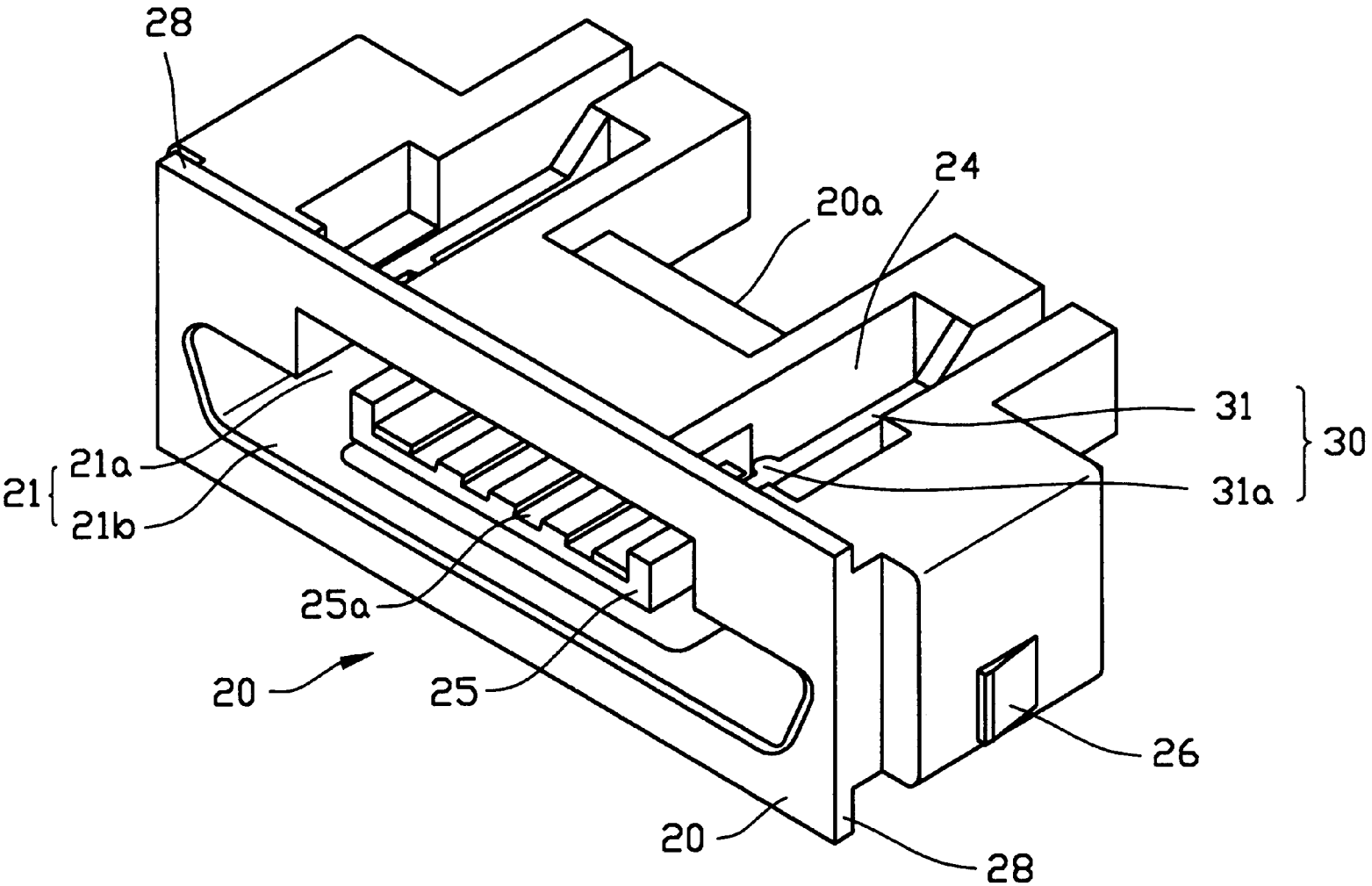
FIG. 2 is a perspective view of a housing in accordance with the present invention.
Figure 3:
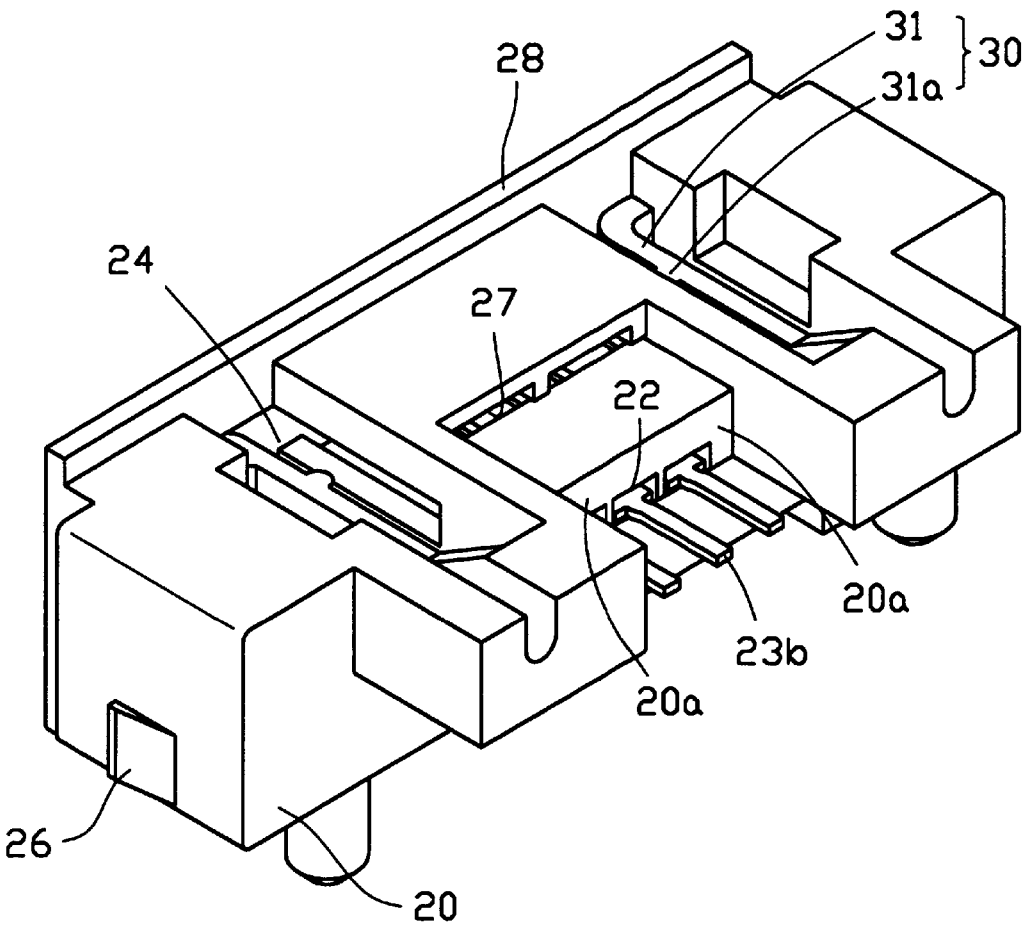
FIG. 3 is a rear view of FIG. 2.
Figure 4:
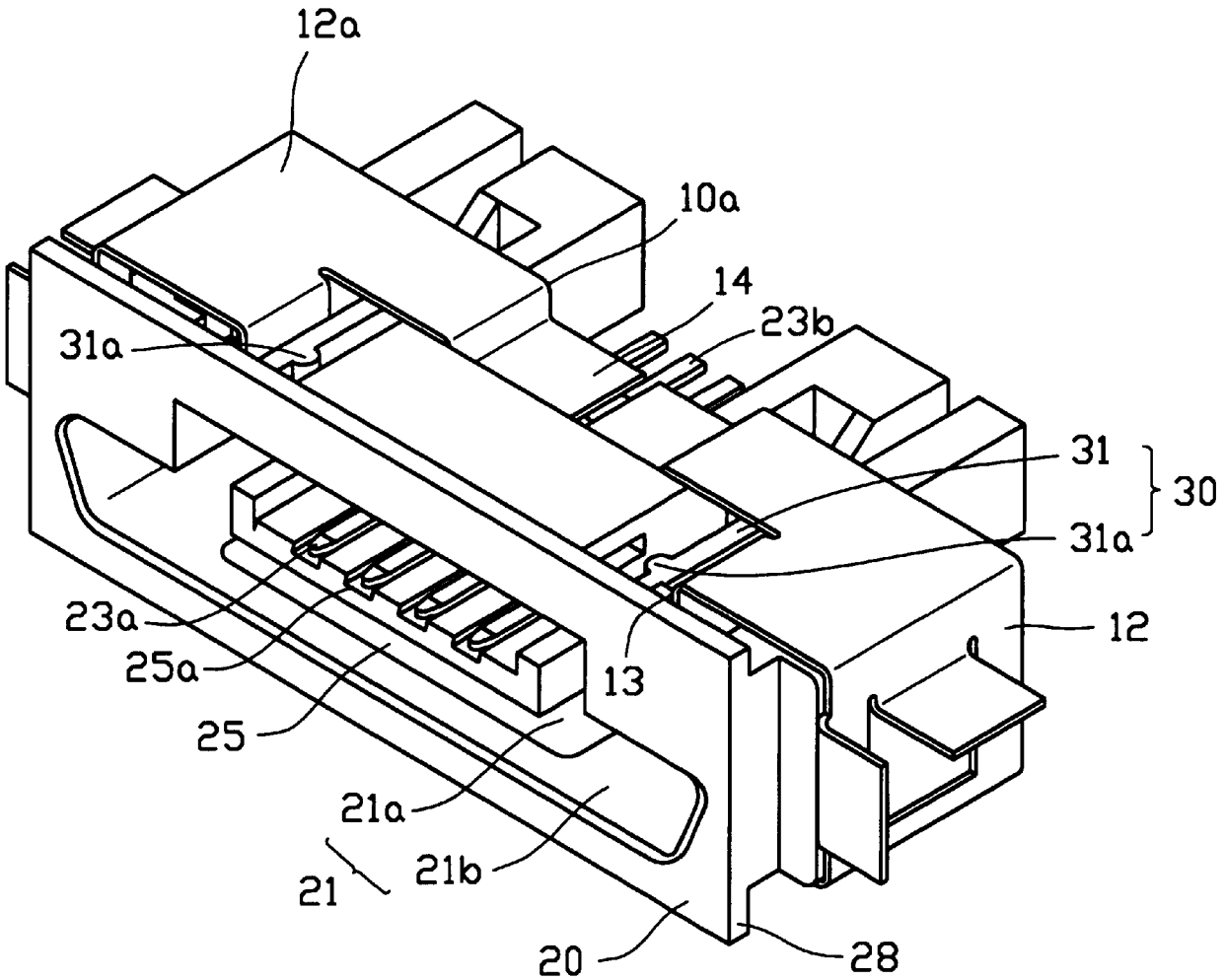
FIG. 4 is an assembled view of the metal shield and the housing.
Figure 5:
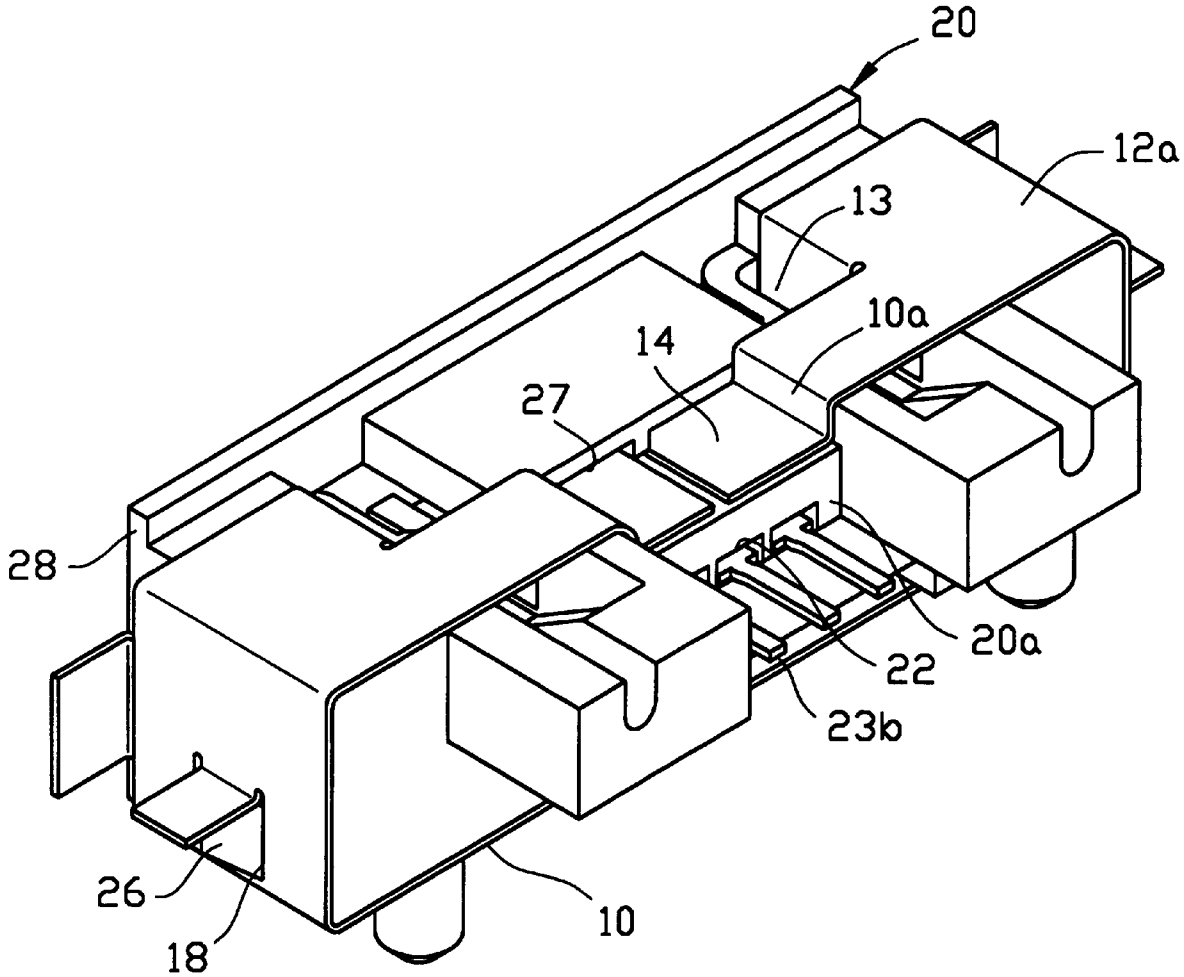
FIG. 5 is a rear view of FIG. 2.
Figure 6:
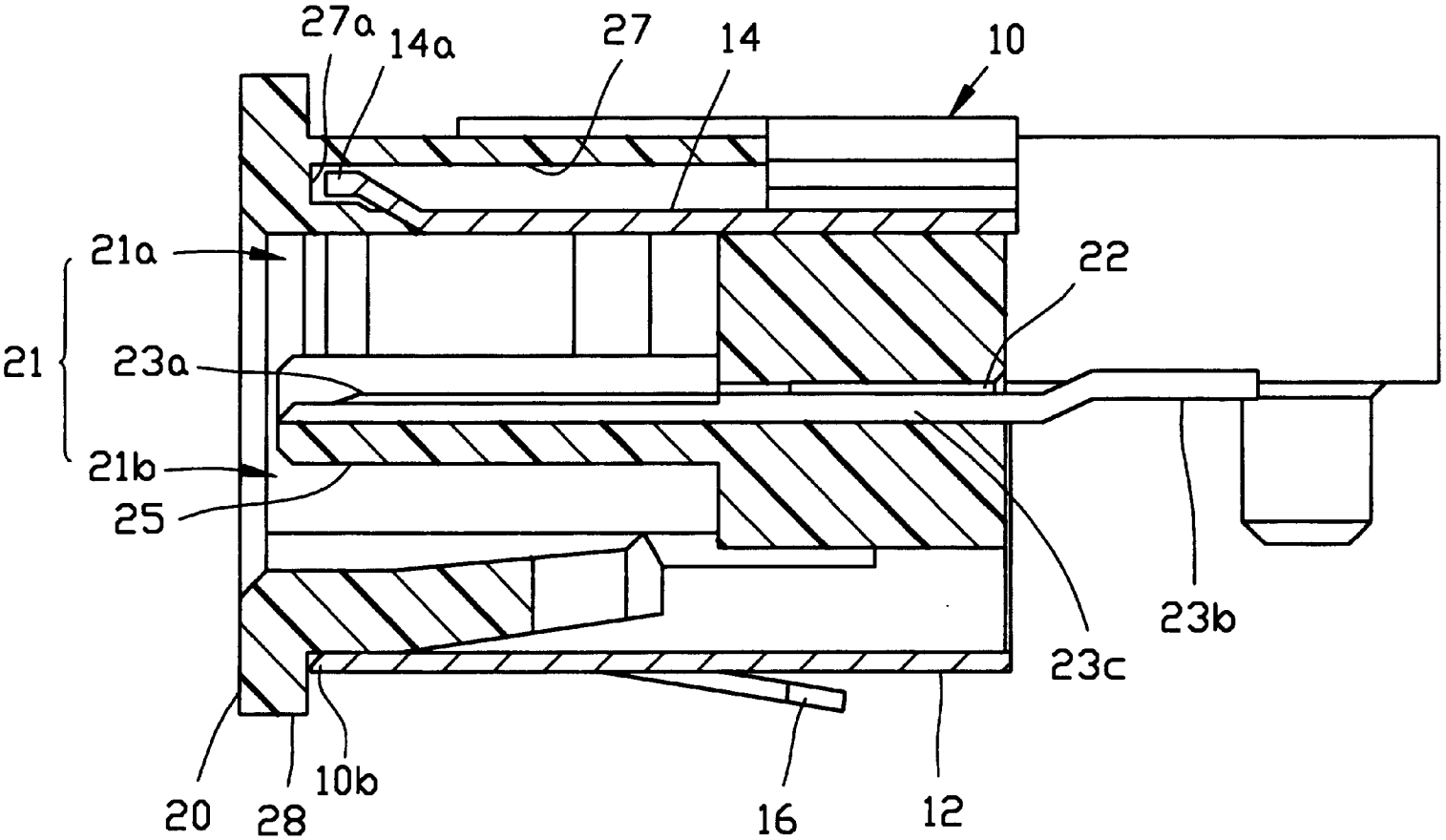
FIG. 6 is a cross sectional view taken along line 5—5 of FIG. 5.
Figure 7:
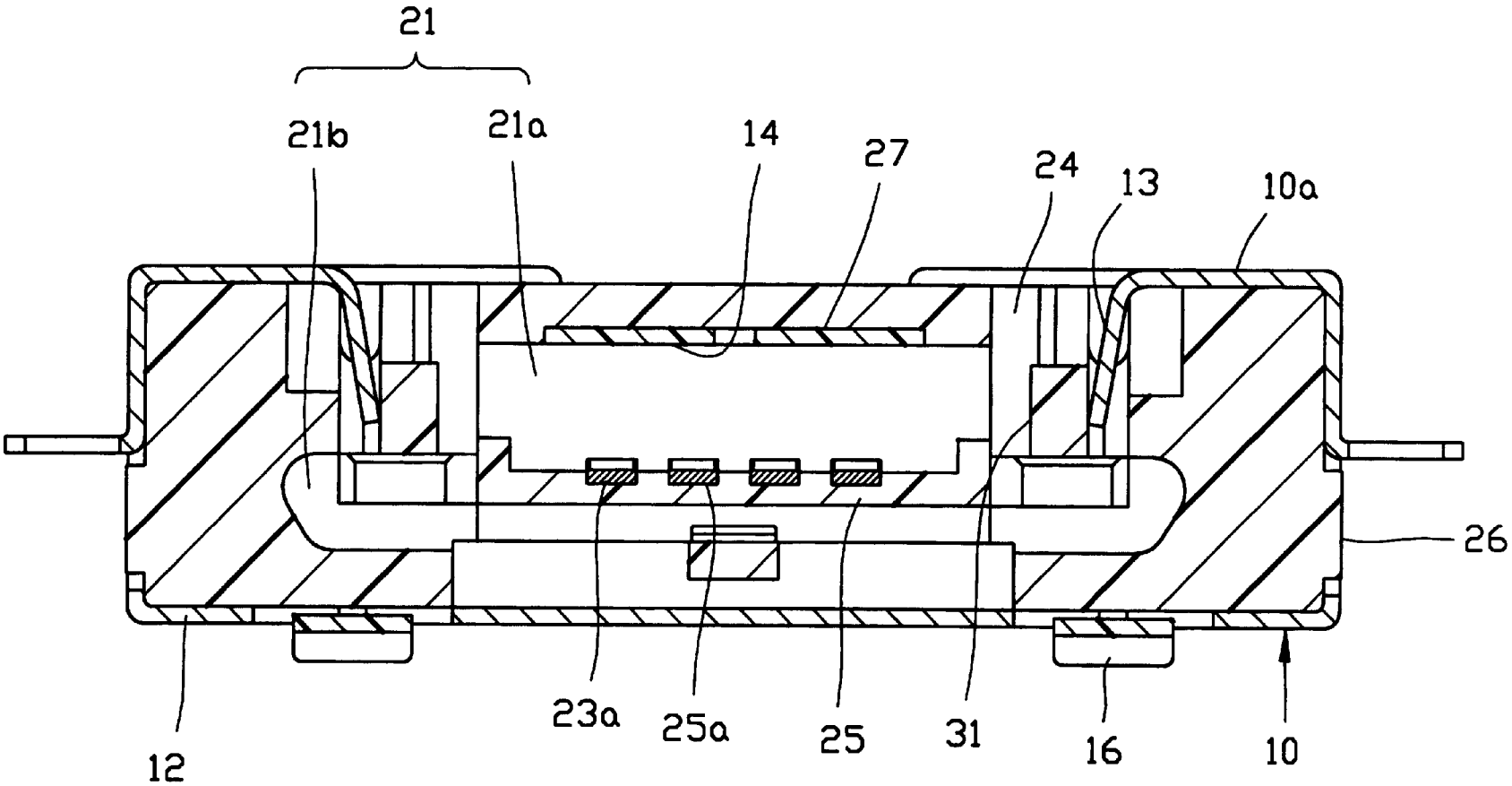
FIG. 7 is a cross sectional view taken along line 7—7 of FIG. 4.

Referring to FIGS. 1 to 7, a metal shield 10 in accordance with the present invention defines a receiving chamber 11 defined by peripheral wall 12 which includes a top wall portion 12*a*, a bottom wall portion 12*b* and two side wall portions 12*c*. A pair of biasing tabs 13 is integrally formed on the top wall portion 12*a* of the peripheral wall 12 and extends downward therefrom. A pair of grounding tabs 14 extends forward from the top wall portion 12*a*. According to the present invention, the metal shield 10 is formed by a single metal sheet (not labeled) and ends 10*a* of the metal sheet are located on the top wall portion 12*a*. The grounding tabs 14 extend from ends 10*a* of the metal sheet. The metal shield 10 further includes contacting tabs 16 for electrically contacting with other grounding path (not shown). The metal shield 10 further includes retaining windows 18 at side wall.

A housing 20 in accordance with the present invention defines a receiving cavity 21. The cavity 21 is divided into an upper portion 21*a* and a lower portion 21*b* which is wider than the upper portion 21*a* according to the preferable embodiment. The housing 20 includes a rear wall 20*a* in which a plurality of passageways 22 extends therethrough. Each of the passageways 22 receives a terminal 23 therein. The housing 20 has a top outer surface 20*b* and two opening 24 are defined therein. The openings 24 are in communication with the upper portion 21*a* of the cavity 21. A tongue 25 extends from the rear wall 20*a* and defines a plurality of slots 25*a* aligned with the passageways 22. Each terminal 23 includes a body portion (not labeled) received in the passageway 22, a mating portion 23*a* extending into a corresponding slot 25*a*, and a tail portion 25*b* extending beyond the housing 20. The housing 20 further includes retaining wedges 26 at out side walls (not labeled). The upper portion 21*a* of the cavity 21 further defines a pair of slots 27 for receiving the grounding tab 14. The slots 27 are accessible from a rear portion of the housing 20.

When the metal shield 10 is assembled to the housing 10 along a back-to-forward direction, the housing 20 will be snugly received within the receiving chamber 11 of the metal shield 10 and the grounding tabs 14 extend into the slot 27 and are snugly retained therein. In addition, an end 14*a* of the grounding tab 14 is retained within an end 27*a* of the slot 27. Accordingly, the grounding tab 14 is properly assembled with the housing 20. The retaining window 18 of the metal shield 10 will also engaged with the wedges 26 of the housing 20. Furthermore, a front edge 10*b* of the metal shield 10 will abut against a dam portion 28 of the housing 20, as a result, the metal shield 10 is snugly assembled with the housing 20.

Clipping means 30 is formed in the openings 24 to interlock a mated connector (not shown). According to a preferred embodiment, the clipping means 30 includes an elongate strip 31 bridged between longitudinal ends 24*a* of the opening 24. According to the preferred embodiment, each opening 24 is formed with a strip 31. Each strip 31 includes a biasing dimple 31*a* extending into the upper portion 21*a* of the cavity 21 and intersecting an inserting path of the mated connector (not shown). Accordingly, when the mated connector is inserted, a recess thereof will engage with the biasing dimple 31*a* such that the mated connector is firmly retained therein.

When the metal shield 10 is assembled to the housing 20 along the back-to-forward direction, the biasing tab 13 extends into the opening 24 and abuts against the strip 31. Accordingly, the strip 31 together with its biasing dimple 31*a* are increased with its resilience from the biasing tab 13. As it can be understood from FIG. 7, when the mated connector is inserted, the biasing dimple 31*a* is pushed backward to allow the mated connector to come in. After the recess of the mated connector is engaged with the biasing dimple 31*a*, the resilience of the biasing dimple 31*a* may effectively keep the biasing dimple 31*a* in the engaged position even after a plurality of insertion/withdrawal.

In addition, after the metal shield 10 is assembled to the housing 20, the grounding tabs 14 extend into the upper portion 21*a* of the cavity 21. By this arrangement, a grounding device of the inserted connector is also grounded with the grounding tabs 14.

As the strips 31 are supported by the biasing tabs 13, not only the retaining force of the biasing dimple 31*a* will be increased, but also the life span of the strips 31 is increased as well as what is disclosed in the copending application Ser. No. 09/364,834 filed Jul. 30, 1999. The conventional problems are completely solved by the introduction of the present invention.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An electrical connector, comprising:

a housing defining a receiving cavity, said cavity defining at least a rear wall thereof, a plurality of passageways extending through said rear wall, said housing having thereof a top outer surface and therein at least an opening therein in communication with said cavity;

a tongue extending from said rear wall and defining a plurality of slots aligned with said passageways;

resilient clipping means formed in said housing, said clipping means extending along a longitudinal direction of each of said passageways and being deflectable in a transverse direction perpendicular to said longitudinal direction for engaging with a mating connector inserted into said cavity; and a metal shield enclosing a periphery of said housing, and including a biasing tab extending into said opening and abutting against said clipping means toward the cavity;

wherein said clipping means includes an elongate strip bridging between longitudinal ends of said opening, said strip including a biasing dimple extending into said cavity for engaging with said mating connector;

wherein said cavity is divided into upper and lower portions, said tongue being located in a separating plane between said upper and lower portions;

wherein said opening is in communication with said upper portion of said cavity;

wherein said metal shield includes at least a grounding tab extending into said cavity.

* * * * *